US008919911B2

(12) United States Patent
Sawase

(10) Patent No.: US 8,919,911 B2
(45) Date of Patent: Dec. 30, 2014

(54) IMAGE FORMING APPARATUS INCLUDING RECORDING HEAD AND HEAD TANK

(71) Applicant: Hiroshi Sawase, Kanagawa (JP)

(72) Inventor: Hiroshi Sawase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 17 days.

(21) Appl. No.: 13/771,315

(22) Filed: Feb. 20, 2013

(65) Prior Publication Data

US 2013/0222460 A1 Aug. 29, 2013

(30) Foreign Application Priority Data

Feb. 24, 2012 (JP) ..... 2012-039291

(51) Int. Cl.

| | |
|---|---|
| ***B41J 29/393*** | (2006.01) |
| ***B41J 2/175*** | (2006.01) |
| *B41J 2/195* | (2006.01) |
| *B41J 2/18* | (2006.01) |
| *B41J 2/19* | (2006.01) |

(52) U.S. Cl.

CPC ..... *B41J 2/175* (2013.01); *B41J 2/17509* (2013.01); *B41J 2/17566* (2013.01); *B41J 2/19* (2013.01)

USPC ..... 347/19; 347/7; 347/89; 347/92

(58) Field of Classification Search

CPC .... B41J 2/175; B41J 2/17506; B41J 2/17509; B41J 2/17566; B41J 2/17596; B41J 2/19; B41J 2002/17566; B41J 2002/17569; B41J 2002/17573; B41J 2002/17756; B41J 2002/17579; B41J 2002/17583; B41J 2002/17586

USPC ..... 347/7, 19, 89, 92

See application file for complete search history.

(56) References Cited

U.S. PATENT DOCUMENTS

| | | | | |
|---|---|---|---|---|
| 7,540,598 | B2 * | 6/2009 | Hori et al. | 347/86 |
| 7,600,862 | B2 * | 10/2009 | Umeda | 347/84 |
| 7,621,626 | B2 * | 11/2009 | Umeda | 347/85 |
| 7,771,179 | B2 * | 8/2010 | Kubota et al. | 417/474 |
| 8,020,983 | B2 * | 9/2011 | Nishimori | 347/92 |
| 8,042,920 | B2 * | 10/2011 | Nishimori | 347/84 |

(Continued)

FOREIGN PATENT DOCUMENTS

JP 2010-155446 7/2010

OTHER PUBLICATIONS

U.S. Appl. No. 13/557,678, filed Jul. 25, 2012, Hiroshi Sawase.

*Primary Examiner* — Laura Martin
*Assistant Examiner* — Jeremy Bishop
(74) *Attorney, Agent, or Firm* — Cooper & Dunham LLP

(57) ABSTRACT

An image forming apparatus includes a recording head, a head tank, a main tank, a liquid feed device, and a controller. When the main tank is in an ink end state, the controller causes the feed device to feed the liquid in reverse from the head tank to the main tank. When air is unlikely to be mixed with the liquid or the liquid is unlikely to be bubbled in the head tank before installation of a new main tank, the controller causes the feed device to feed the liquid from the main tank to the head tank with an air release unit opened after the installation. When air is likely to be mixed with the liquid or the liquid is likely to be bubbled in the head tank before the installation, the controller causes the feed device to feed the liquid with the release unit closed after the installation.

3 Claims, 10 Drawing Sheets

(56) References Cited

U.S. PATENT DOCUMENTS

| | | | | |
|---|---|---|---|---|
| 8,201,912 | B2 * | 6/2012 | Iwase et al. | 347/17 |
| 8,317,282 | B2 * | 11/2012 | Satoh et al. | 347/7 |
| 8,366,257 | B2 * | 2/2013 | Sasaki et al. | 347/89 |
| 8,523,339 | B2 * | 9/2013 | Tokuno | 347/86 |
| 8,540,352 | B2 * | 9/2013 | Igarashi | 347/85 |
| 2006/0132554 | A1 * | 6/2006 | Ota et al. | 347/85 |
| 2008/0273064 | A1 * | 11/2008 | Ota et al. | 347/85 |
| 2008/0273070 | A1 * | 11/2008 | Mun et al. | 347/92 |
| 2010/0026742 | A1 * | 2/2010 | Morino | 347/7 |
| 2010/0231622 | A1 | 9/2010 | Sasaki et al. | |
| 2010/0231662 | A1 * | 9/2010 | Ara et al. | 347/85 |
| 2011/0226340 | A1 * | 9/2011 | Tokuno | 137/1 |

* cited by examiner

IMAGE FORMING APPARATUS INCLUDING RECORDING HEAD AND HEAD TANK

CROSS-REFERENCE TO RELATED APPLICATIONS

This patent application is based on and claims priority pursuant to 35 U.S.C. §119 to Japanese Patent Application No. 2012-039291, filed on Feb. 24, 2012, in the Japan Patent Office, the entire disclosure of which is hereby incorporated by reference herein.

BACKGROUND

1. Technical Field

This disclosure relates to an image forming apparatus, and more specifically to an image forming apparatus including a recording head for ejecting liquid droplets and a head tank for supplying liquid to the recording head.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, inkjet recording apparatuses are known that use a recording head (liquid ejection head or liquid-droplet ejection head) for ejecting droplets of ink or other liquid.

Such inkjet-type image forming apparatuses may have a head tank (also referred to as sub tank) on a recording head to supply ink from an ink cartridge serving as a main tank replaceably mounted on an apparatus body.

For an image forming apparatus having such an ink supply system, when the ink cartridge in an ink end state is replaced, the interior of the ink cartridge is in a negative pressure. Hence, for example, JP-2010-155446-A proposes to feed a desired amount of ink in reverse from the head tank to the ink cartridge and release the negative pressure in the ink cartridge in the ink end state to prevent air from intruding into a liquid feed passage when the ink cartridge is removed for replacement.

However, if ink is fed in reverse from the head tank to the ink cartridge when an ink level of the head tank is low, bubbles may be fed into the liquid feed passage. Even when the ink level of the head tank is not low, bubbles may be fed into the liquid feed passage if bubbles are already included in the head tank.

If bubbles intrude into the liquid feed passage as described above, bubbles may be fed to the head tank when ink is fed from a new ink cartridge to the head tank with art air release valve of the head tank opened. For example, when the ink level of the head tank is detected with electrode pins, bubbles may hamper detection of the ink level. As a result, ink is oversupplied and bubbled ink may intrude into the air release valve, thus causing a failure.

Hence, as described above, when the ink level of the head tank is low or bubbles are likely to intrude into the liquid feed passage, the image forming apparatus does not feed ink in reverse from the head tank to the ink cartridge.

As a result, since the negative pressure in the ink cartridge in the end state cannot be released, the image forming apparatus needs to feed ink based on the assumption that air intrudes into the liquid feed passage after replacement of ink cartridges, thus increasing the liquid feed time and the ink consumption amount.

BRIEF SUMMARY

In an aspect of this disclosure, there is provided an image forming apparatus including a recording head, a head tank, a main tank, a reversible liquid feed device, a controller, and an air release unit. The recording head ejects droplets of liquid. The head tank stores the liquid to be supplied to the recording head. The main tank stores the liquid to be supplied to the head tank. The reversible liquid feed device is disposed between the main tank and the head tank. The controller controls the liquid feed device to feed the liquid from the main tank to the head tank and in reverse from the head tank to the main tank. The air release unit is disposed at the head tank to open an interior of the head tank to an atmosphere. When the main tank is in an ink end state, the controller causes the liquid feed device to feed a predetermined amount of the liquid in reverse from the head tank to the main tank. When air is unlikely to be mixed with the liquid in the head tank or the liquid is unlikely to be bubbled in the head tank before a new main tank is installed in replacement of the main tank, the controller causes the liquid feed device to feed the liquid from the main tank to the head tank with the air release unit opened after the new main tank is installed in replacement of the main tank. When air is likely to be mixed with the liquid in the head tank or the liquid is likely to be bubbled in the head tank before the new main tank is installed in replacement of the main tank, the controller causes the liquid feed device to feed the liquid from the main tank to the head tank with the air release unit closed after the new main tank is installed in replacement of the main tank.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
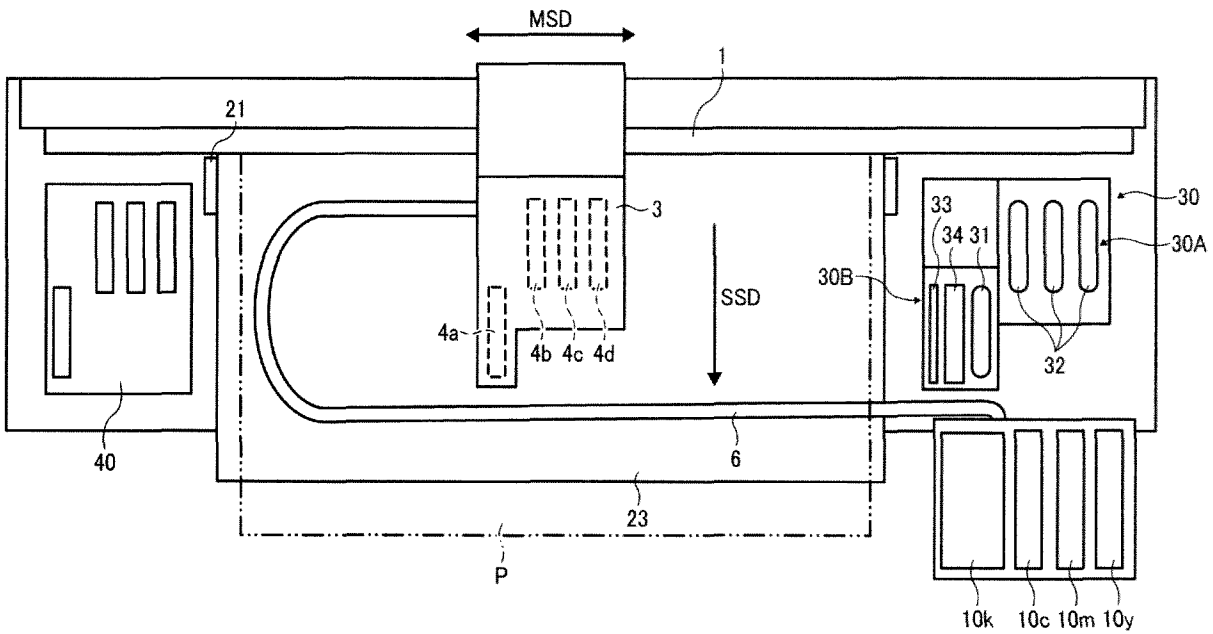
FIG. 1 is a schematic plan view of a mechanical section of an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIGS. 1 and 2.

Figure 2:
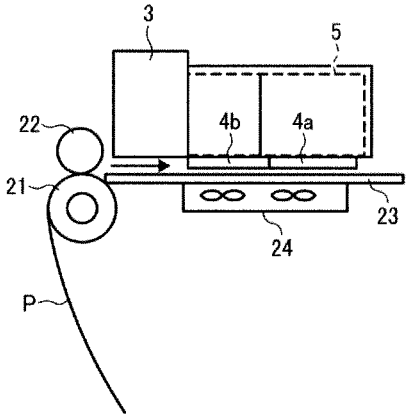
FIG. 2 is a partial side view of the mechanical section of FIG. 1.

FIG. 1 is a partial plan view of a mechanical section of an image forming apparatus according to an exemplary embodiment of this disclosure. FIG. 2 is a partial side view of the mechanical section of FIG. 1.

In this exemplary embodiment, the image forming apparatus is a serial-type image forming apparatus. In the image forming apparatus, a carriage 3 is supported by a main guide rod 1 and a sub guide rod so as to be movable in a direction (main scanning direction) indicated by an arrow MSD in FIG. 1. The main guide rod 1 and the sub guide rod extend between left and right side plates. A main scanning motor reciprocally moves the carriage 3 for scanning in the main scanning direction MSD via a timing belt extending between a driving pulley and a driven pulley.

The carriage 3 mounts recording heads 4*a*, 4*b*, 4*c*, and 4*d* (collectively referred to as "recording heads 4" unless distinguished) serving as four liquid ejection heads for ejecting liquid droplets. The carriage 3 mounts the recording heads 4 so that nozzle rows, each of which includes multiple nozzles, are arranged in parallel to a sub scanning direction (indicated by an arrow SSD in FIG. 1) perpendicular to the main scanning direction MSD and ink droplets are ejected downward from the nozzles.

On the carriage 3, the recording head 4*a* is displaced from the recording heads 4*b*, 4*c*, and 4*d* by one head (one nozzle row) in the sub-scanning direction SSD perpendicular to the main scanning direction MSD. Each of the recording heads 4*a* to 4*d* has two nozzle rows. For example, each of the recording heads 4*a* and 4*b* ejects liquid droplets of the same color, black. The recording heads 4*c* and 4*d* eject liquid droplets of magenta (M), cyan (C), and yellow (Y).

Thus, for monochrome images, the image forming apparatus uses the recording heads 4*a* and 4*b* to form an image having a width of two heads by one scanning (main scanning). For color images, the image forming apparatus can use, for example, the recording heads 4*b*, 4*c*, and 4*d* to form a color image.

The recording heads 4*a* to 4*d* are provided with respective head tanks 5 to supply liquid to the corresponding recording heads 4. Different color inks are supplied from ink cartridges 10*k*, 10*c*, 10*m*, and 10*y* to the head tanks 5 via supply tubes 6. The ink cartridges 10 serve as main tanks replaceably mounted on an apparatus body 101. To the two recording heads 4*a* and 4*b* for ejecting the same color of droplets, ink is supplied from the ink cartridge 10*k*.

The image forming apparatus also includes a conveyance device including a conveyance roller 21, a pressure roller 22, a platen member 23, and a suction fan 24. The conveyance roller 21 conveys a sheet (e.g., a rolled sheet P) to a position opposing the recording heads 4. The pressure roller 22 is pressed by and contacts the conveyance roller 21. The platen member 23 is disposed at a position opposing the recording heads 4. The suction fan 24 sucks the rolled sheet P via suction holes of the platen member 23 to adhere the rolled sheet P onto the platen member 23.

In FIG. 1, the image forming apparatus further includes a maintenance assembly (maintenance and recovery assembly) 30 at one side to maintain and recovery the recording heads 4, and a first dummy ejection receptacle 40 at the opposite side to receive liquid droplets ejected during dummy ejection in which liquid droplets not contributing to image formation are ejected from the recording heads 4.

The maintenance assembly 30 includes a first maintenance device 30A held by the apparatus body 101 and a second maintenance device 30B supported by the apparatus body 101 so as to be reciprocally movable in the sub-scanning direction indicated by the arrow SSD in FIG. 1. When maintenance or recovery operation is performed on the recording head 4*a*, the second maintenance device 30B is placed at a position illustrated in FIG. 1. When maintenance or recovery operation is performed on one of the recording heads 4*b* to 4*d*, the second maintenance device 30B is moved to the same position as the position of the first maintenance device 30A in FIG. 1 in the sub scanning direction SSD.

The maintenance assembly 30 includes, for example, a suction cap 31 and moisture-retention caps 32. The suction cap 31 caps a nozzle face (nozzle formed face) of any one of the recording heads 4 to suck liquid from the nozzle face. The moisture-retention caps 32 cap nozzle faces of the recording heads 4*b*, 4*c*, and 4*d* for moisture retention. The suction cap 31 also serves as a moisture-retention cap. The maintenance assembly 30 also includes a wiper member 33 to wipe the nozzle faces of the recording heads 4 and a second dummy ejection receptacle 34 to receive liquid droplets not contributing to image formation and ejected from the recording heads 4 during dummy ejection.

For the image forming apparatus having the above-described configuration, a rolled sheet P is fed from a sheet feed device and conveyed in the sub-scanning direction by the conveyance roller 21 and the pressure roller 22 while being adhered on the platen member 23.

By driving the recording heads 4 in accordance with image signals while moving the carriage 3 in the main scanning direction MSD, ink droplets are ejected onto the rolled sheet P, which is stopped below the recording heads 4, to form one line of a desired image. After the rolled sheet P is fed by a certain distance, another line of the image is recorded. Such operations are repeated and the rolled sheet P is sequentially output.

Next, an example of the head tank 5 is described with reference to FIGS. 3 and 4.

Figure 3:
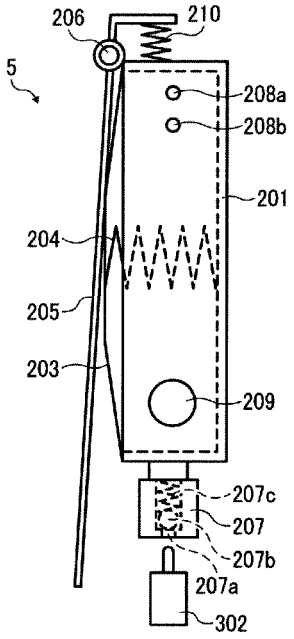
FIG. 3 is a schematic plan view of an example of a head tank of the image forming apparatus.
Figure 4:
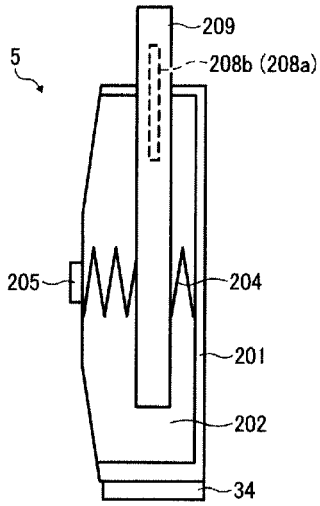
FIG. 4 is a schematic front cross sectional view of the head tank illustrated in FIG. 3.

FIG. 3 is a schematic plan view of the head tank 5. FIG. 4 is a schematic front view of the head tank 5 of FIG. 3.

The head tank 5 has a tank case 201 forming an ink storage part 202 to store ink and having art opening at one side. The opening of the tank case 201 is sealed with a film member 203 serving as a flexible member, and the film member 203 is constantly urged outward by a restoring force of a spring 204 serving as an elastic member disposed in the tank case 201. Thus, since the restoring force of the spring 204 acts on the film member 203 of the tank case 201, a decrease in the remaining amount of ink in the ink storage part 202 of the tank case 201 creates a negative pressure.

At the exterior of the tank case 201, a displacement member (hereinafter, may also be referred to as simply "feeler") 205 formed with a feeler having one end swingably supported by a support shaft 206 is fixed on the film member 203 by, e.g., adhesion. The displacement member 205 is urged toward the tank case 201 by a spring 210 and displaces with movement of the film member 203.

By detecting the displacement member 205 with, e.g., a first detector (first sensor) 251 mounted on the carriage 3 or a second detector (second sensor) 301 disposed at the apparatus body 101, the remaining amount of ink or negative pressure in the head tank 5 can be detected.

A supply port portion 209 is disposed at an upper portion of the tank case 201 and connected to a supply tube 6 to supply ink from an ink cartridge 10. At one side of the tank case 201, an air release unit 207 is disposed to release the interior of the head tank 5 to the atmosphere.

The air release unit 207 includes an air release passage 207*a* communicating with the interior of the head tank 5, a valve body 207*b* to open and close the air release passage 207*a*, and a spring 207*c* to urge the valve body 207*b* into a closed state. An air release solenoid 302 is disposed at the apparatus body 101, and the valve body 207*b* is pushed by the air release solenoid 302 to open the air release passage 207*a*, thus causing the interior of the head tank 35 to be opened to the atmosphere (in other words, causing the interior of the head tank 35 to communicate with the atmosphere).

The head tank 5 is provided with electrode pins 208*a* and 208*b* serving as a liquid level detector to detect a liquid level of ink in the head tank 35. Since ink has conductivity, when ink reaches the electrode pins 208*a* and 208*b*, electric current flows between the electrode pins 208*a* and 208*b* and the resistance values of the electrode pins 208*a* and 208*b* change. Such a configuration can detect that the liquid level of ink has decreased to a threshold level or lower, in other words, the amount of air in the head tank 35 has increased to a threshold amount or more.

Next, an ink supply-and-discharge system of the image forming apparatus is described with reference to FIGS. 5 and 6.

Figure 5:
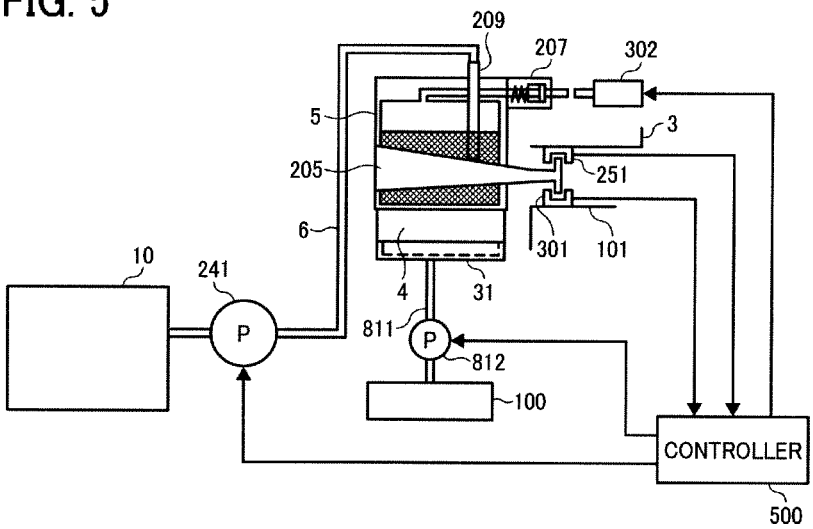
FIG. 5 is a schematic view of an ink supply-and-discharge system of the image forming apparatus.

FIG. 5 is a schematic view of the supply-and-discharge system. FIG. 6 is a schematic view of a supply system for two recording heads to eject liquid droplets of the same color.

A liquid feed pump 241 serving as a liquid feed device supplies ink from the ink cartridge 10 (hereinafter, main tank) to the head tank 5 via the supply tube 6. The liquid feed pump 241 is a reversible pump, e.g., a tube pump, capable of performing normal feed operation to supply ink from the ink cartridge 10 to the head tank 5 and reverse feed operation to return ink from the head tank 5 to the ink cartridge 10.

Figure 6:
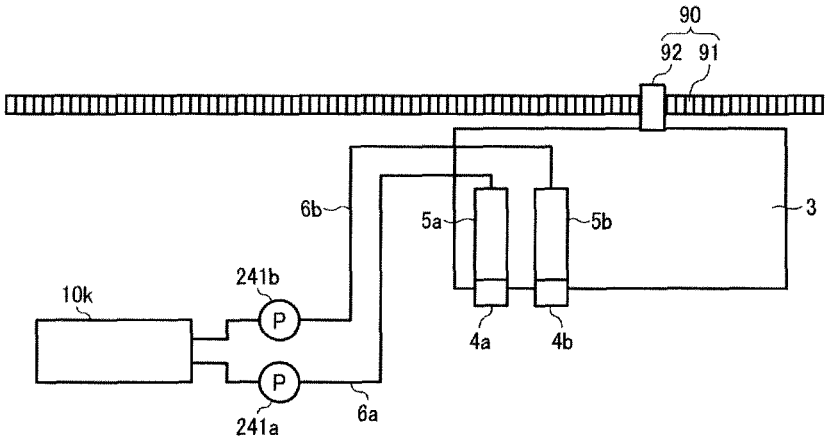
FIG. 6 is a schematic partial front view of the ink supply-and-discharge system.

In this exemplary embodiment, as illustrated in FIG. 6, the same color of ink is supplied from a single tank, i.e., the main tank (ink cartridge) 10*k* to two head tanks 5*a* and 5*b* for the recording heads 4*a* and 4*b*. Liquid feed pumps 241*a* and 241*b* supply ink to the head tanks 5*a* and 5*b* via supply tubes 6*a* and 6*b*.

As described above, the maintenance assembly 30 includes the suction cap 31 to cap a nozzle face of any one of the recording heads 4 and a suction pump 812 connected to the suction cap 31. The suction pump 812 is driven with the nozzle face capped with the suction cap 31 to suck ink from the nozzles via a suction tube 811, thus allowing ink to be sucked from the head tank 5. Waste ink sucked from the head tank 5 is discharged to a waste liquid tank 100.

The air release solenoid 302 serving as a pressing member to open and close the air release unit 207 of the head tank 5 is disposed at the apparatus body 101. By activating the air release solenoid 302, the air release unit 207 can be opened.

At the carriage 3 is mounted the first sensor 251 that is an optical sensor serving as the first detector to detect the displacement member 205. At the apparatus body 101 is disposed the second sensor 301 that is an optical sensor serving as the second detector to detect the displacement member 205. As described below, ink supply operation for supplying ink to the head tank 5 is controlled based on detection results of the first sensor 251 and the second sensor 301.

As illustrated in FIG. 6, an encoder scale 91 is disposed so as to extend along the main scanning direction of the carriage 3. An encoder sensor 92 is mounted on the carriage 3 to read the encoder scale 91. The encoder scale 91 and the encoder sensor 92 form a linear encoder 90. Main scanning positions (carriage positions) and movement amounts of the carriage 3 are detected by detection signals of the linear encoder 90.

A controller 500 performs driving control of the liquid feed pump 241, the air release solenoid 302, and the suction pump 812 and the ink supply control according to exemplary embodiments of this disclosure.

Next, an outline of the controller 500 of the image forming apparatus is described with reference to FIG. 7.

Figure 7:
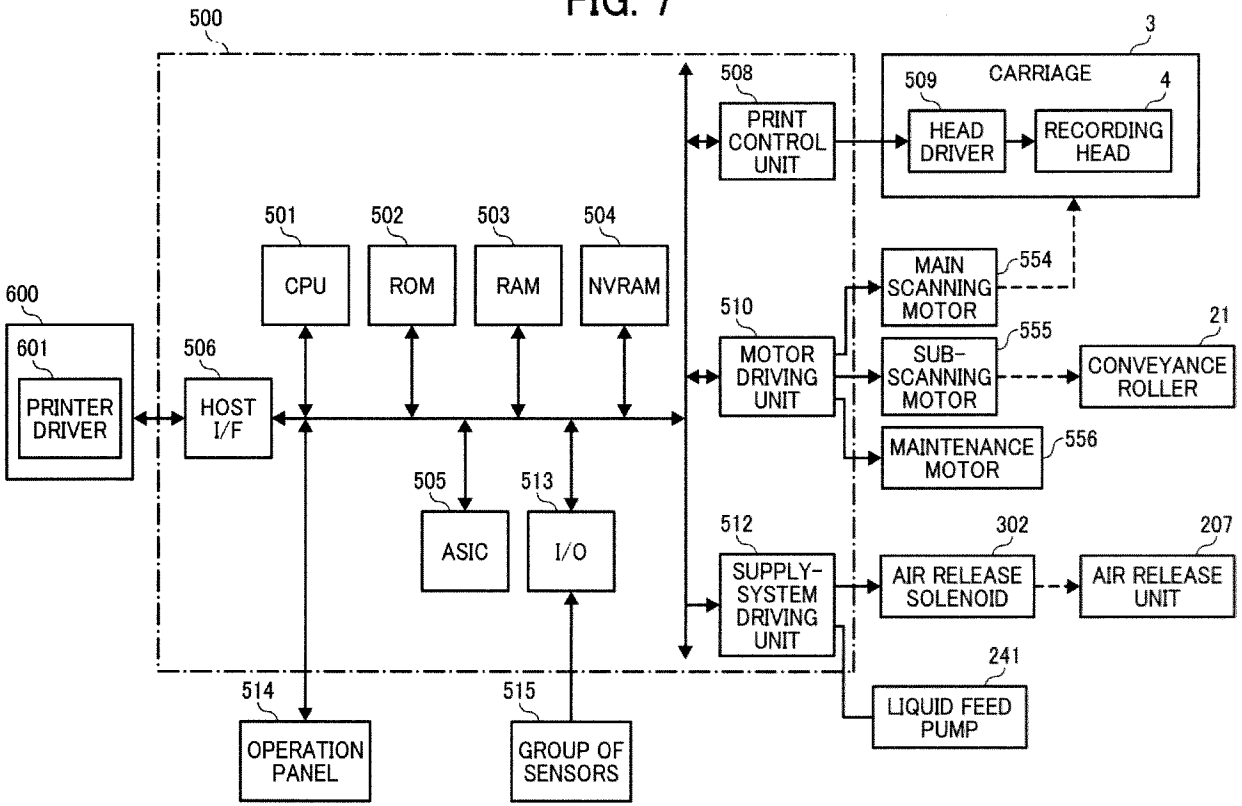
FIG. 7 is a schematic block diagram of a controller of the image forming apparatus.

FIG. 7 is a block diagram of the controller 500 of the image forming apparatus.

The controller 500 includes a central processing unit (CPU) 501, a read-only memory (ROM) 502, a random access memory (RAM) 503, a non-volatile random access memory (NVRAM) 504, and an application-specific integrated circuit (ASIC) 505. The CPU 501 manages the control of the entire image forming apparatus and serves as various control units including a supply control unit according to exemplary embodiments of this disclosure. The ROM 502 stores programs executed by the CPU 501 and other fixed data, and the RAM 503 temporarily stores image data and other data. The NVRAM 504 is a rewritable memory capable of retaining data even when the apparatus is powered off. The ASIC 505 processes various signals on image data, performs sorting or other image processing, and processes input and output signals to control the entire apparatus.

The controller 500 also includes a print control unit 508, a head driver (driver integrated circuit) 509, a main scanning motor 554, a sub scanning motor 555, a motor driving unit 510, the air release solenoid 302, and a supply-system driving unit 512. The print control unit 508 includes a data transmitter and a driving signal generator to drive and control the recording heads 4. The head driver 509 drives the recording heads 4 mounted on the carriage 3. The main scanning motor 554 moves the carriage 3 for scanning, and the sub-scanning motor 555 rotates the conveyance roller 21. The motor driving unit 510 drives a maintenance motor 556 of the maintenance assembly 30. The air release solenoid 302 is disposed at the apparatus body 101 to open and close the air release units 207 of the head tanks 5. The supply-system driving unit 512 drives the liquid feed pumps 241.

The controller 500 is connected to an operation panel 514 for inputting and displaying information necessary to the image forming apparatus.

The controller 500 includes a host interface (I/F) 506 for transmitting and receiving data and signals to and from a host 600, such as an information processing device (e.g., personal computer), an image reading device (e.g., image scanner), or an imaging device (e.g., digital camera), via a cable or network.

The CPU 501 of the controller 500 reads and analyzes print data stored in a reception buffer of the I/F 506, performs desired image processing, data sorting, or other processing with the ASIC 505, and transfers image data from the print control unit 508 to the head driver 509. A printer driver 601 of the host 600 creates dot-pattern data for image output.

The print control unit 508 transfers the above-described image data as serial data and outputs to the head driver 509, for example, transfer clock signals, latch signals, and control signals required for the transfer of image data and determination of the transfer. In addition, the print control unit 508 has the driving signal generator including, e.g., a digital/analog (D/A) converter (to perform digital/analog conversion on pattern data of driving pulses stored on the ROM 502), a voltage amplifier, and a current amplifier, and outputs a driving signal containing one or more driving pulses to the head driver 509.

In accordance with serially-inputted image data corresponding to one image line recorded by the recording heads 4, the head driver 509 selects driving pulses forming driving signals transmitted from the print control unit 508 and applies the selected driving pulses to driving elements (e.g., piezoelectric elements) to drive the recording heads 4. The driving elements serve as pressure generators to generate energy for ejecting liquid droplets from the recording heads 4. At this time, by selecting a part or all of the driving pulses forming the driving signals, the recording heads 4 can selectively eject different sizes of droplets, e.g., large droplets, medium droplets, and small droplets to form different sizes of dots on a recording medium.

An input/output (I/O) unit 513 obtains information from a group of sensors 515 mounted in the image forming apparatus, extracts information required for controlling printing operation, and controls the print control unit 508, the motor driving unit 510, and ink supply to the head tanks 5 based on the extracted information.

Besides the first sensor 251, the second sensor 301, and the detection electrode pins 208*a* and 208*b*, the group of sensors 515 includes, for example, an optical sensor to detect a position of a sheet of recording media, a thermistor (environment temperature and/or humidity sensor) to monitor temperature and/or humidity in the apparatus, a voltage sensor to monitor the voltage of the charged belt, and an interlock switch to detect the opening and closing of a cover. The I/O unit 513 is capable of processing various types of information transmitted from the group of sensors.

Next, control operation in replacement of ink cartridges according to a first exemplary embodiment of this disclosure is described with reference to FIG. 8.

Figure 8:
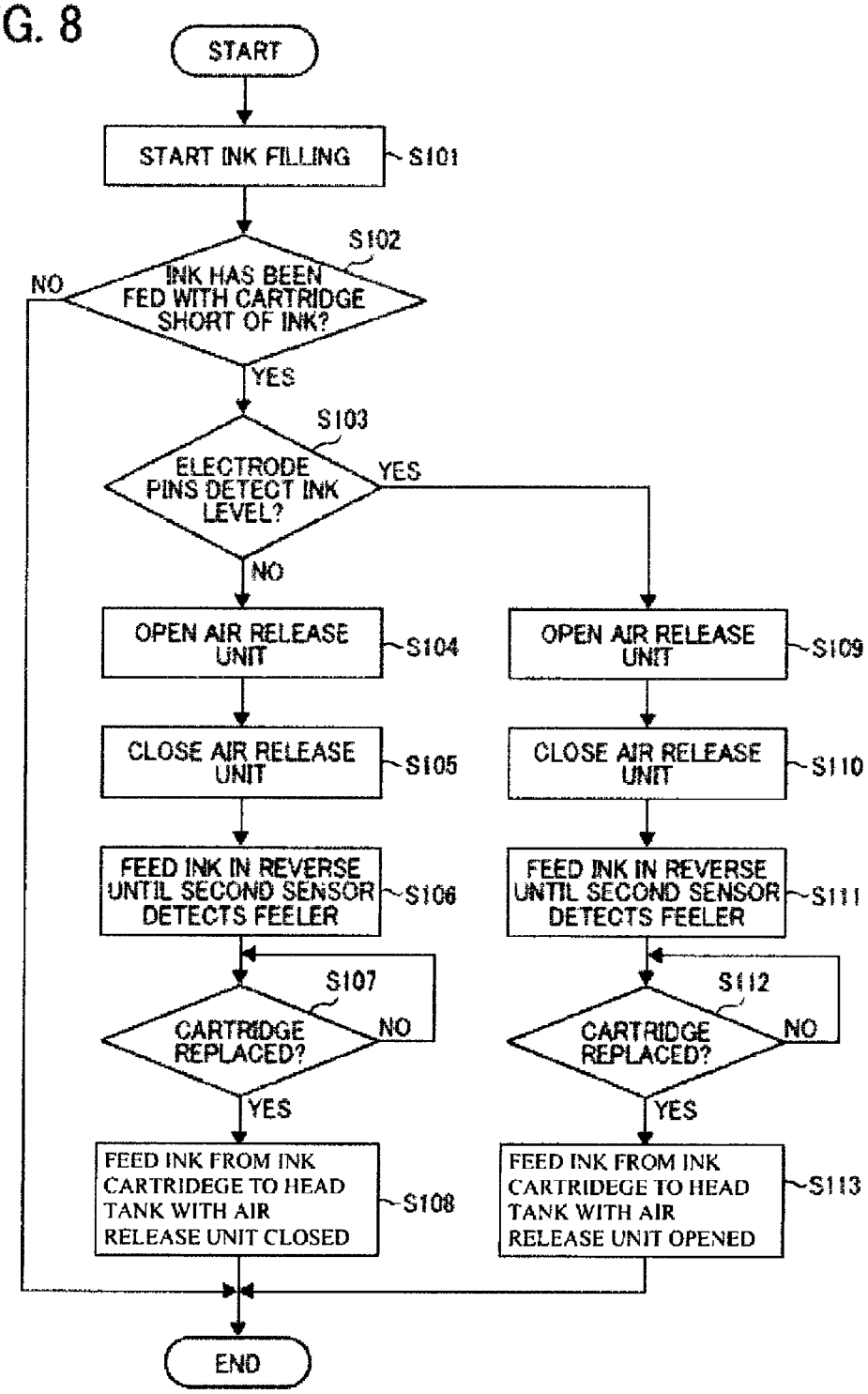
FIG. 8 is a flowchart of a control process according to a first exemplary embodiment of this disclosure performed on replacement of cartridges.

A flowchart of FIG. 8 shows an example in which ink filling is performed after the carriage 3 is returned to a home position. At S101, ink filling is started from an ink cartridge 10 to a head tank 5. At S102, the controller 500 determines whether or not normal feed operation of the corresponding liquid feed pump 241 has been performed with the ink cartridge 10 being short of ink. At this time, if the displacement member 205 of the head tank 5 does not displace when normal feed operation has been performed with the ink cartridge 10 being short of ink, it can be determined that the ink cartridge 10 is in an ink end state (including an ink near-end state).

Figure 9A:
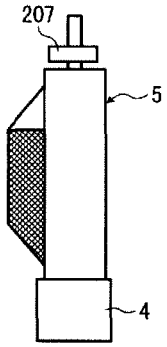
FIG. 9A is a side view of the head tank in a state in which the remaining amount of ink in the head tank is large.
Figure 9B:
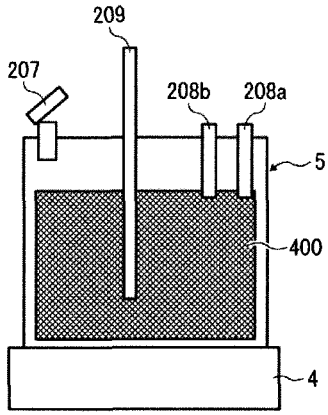
FIG. 9B is a front view of the head tank in the state illustrated in FIG. 9A.
Figure 10A:
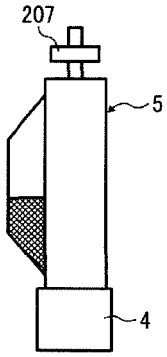
FIG. 10A is a side view of the head tank in a state in which the amount of air in the head tank is large.
Figure 10B:
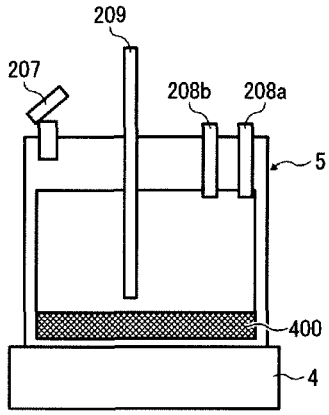
FIG. 10B is a front view of the head tank in the state illustrated in FIG. 10A.

Thus, when normal feed operation has been performed with the ink cartridge 10 as being short of ink (YES at S102), at S103 the controller 500 determines whether the electrode pins 208*a* and 208*b* of the head tank 5 detect an ink level as illustrated in FIG. 9B or do not detect the ink level as illustrated in FIG. 10B before ink feeding. When the electrode pins 208*a* and 208*b* detect an ink level, it can be determined that the amount of air is small and the remaining amount of ink is large. By contrast, when the electrode pins 208*a* and 2086 do not detect the ink level, it can be determined that the amount of air is large and the remaining amount of ink is small.

Then, when the electrode pins 208*a* and 208*b* of the head tank 5 detect the ink level before ink feeding (YES at S103), at S109 the air release unit 207 of the head tank 5 is opened to release the interior of the head tank 5 to the atmosphere. At S110, the air release unit 207 is closed.

At S111, the liquid feed pump 241 is driven for reverse rotation to feed ink in reverse from the head tank 5 to the ink cartridge 10 until the second sensor 301 detects the displacement member 205 of the head tank 5. As a result, a negative pressure in the ink cartridge 10 is released.

When the ink cartridge 10 is replaced (YES at S112), the air release unit 207 of the head tank 5 is opened to release the interior of the head tank 5 to the atmosphere. At S113, ink is fed from the ink cartridge 10 to the head tank 5 until the electrode pins 208*a* and 208*b* detect the ink level.

By contrast, when the electrode pins 208*a* and 208*b* of the head tank 5 do not detect the ink level before ink feeding (NO at S103), at 5104 the air release unit 207 of the head tank 5 is opened to release the interior of the head tank 5 to the atmosphere. At S105, the air release unit 207 is closed.

At S106, the liquid feed pump 241 is driven for reverse rotation to feed ink in reverse from the head tank 5 to the ink cartridge 10 until the second sensor 301 detects the displacement member 205 of the head tank 5. As a result, a negative pressure in the ink cartridge 10 is released.

In this case, air is temporarily fed into a supply passage (the supply tube 6). However, by feeding ink in reverse, the negative pressure in the ink cartridge 10 is released, thus preventing air from intruding to the liquid feed pump 241 in the replacement of the ink cartridge 10.

Then, when the ink cartridge 10 is replaced (YES at S107), at S108 a predetermined amount of ink (not less than an amount of ink fed in reverse at S106) is fed from the ink cartridge 10 to the head tank 5 with the air release unit 207 of the head tank 5 closed, i.e., with the interior of the head tank 5 not released to the atmosphere.

At this time, by feeding the predetermined amount of ink not less than the amount of ink fed in reverse, bubbles are discharged from the supply tube 6 and stopped in the head tank 5. At this time, since the air release unit 207 is closed, ink cannot be leaked from the air release unit 207. Since the amount of ink fed in the reverse feed operation is sufficiently small than an amount of ink which the entire supply passage can store, liquid feed maintenance can be finished with a small consumption amount of ink and in a short time.

When bubbles are stopped in the head tank 5, normal feed operation is not preferably performed with the air release unit 207 opened until a threshold time passes.

Such control can prevent bubbled ink from leaking from the air release unit 207. In addition, since bubbles in the head tank 5 disappear over time, the controller can permit, through time management, normal feed operation with the air release unit 207 opened after the threshold time has passed.

Figure 11:
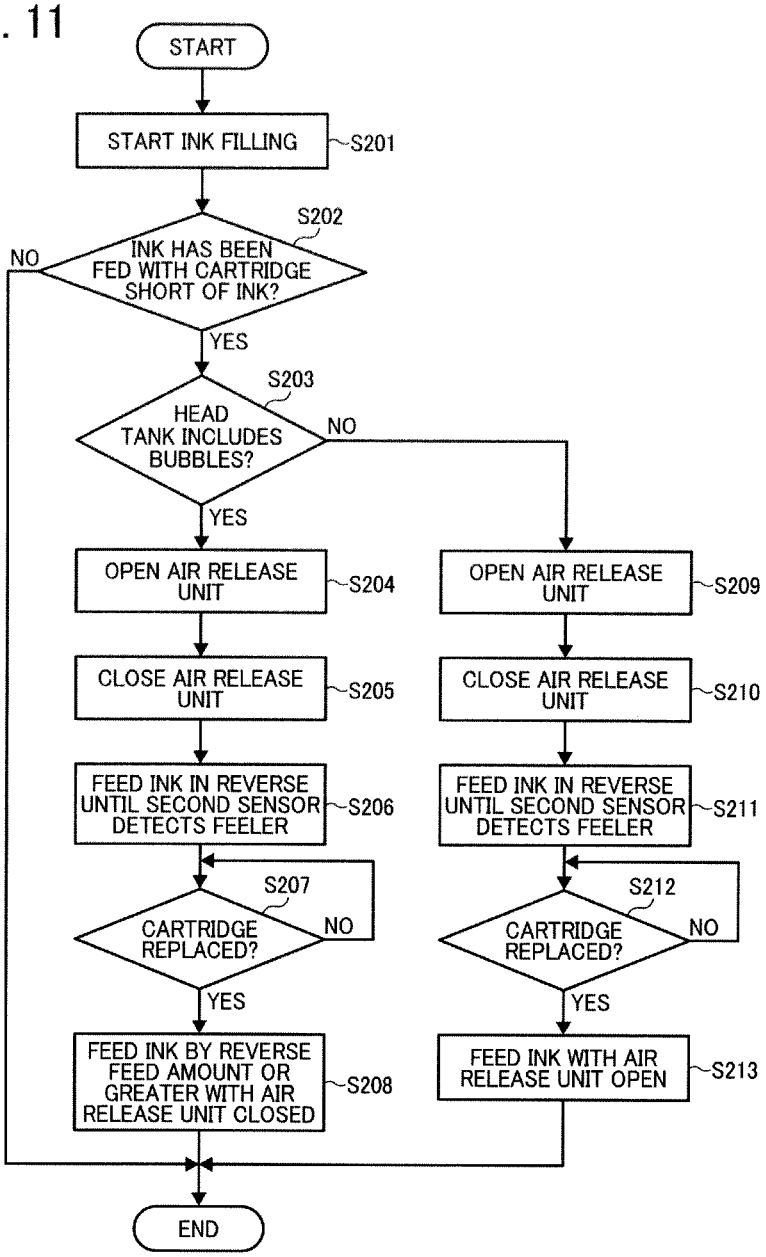
FIG. 11 is a flowchart of a control process according to a second exemplary embodiment of this disclosure performed on replacement of cartridges.

Next, control operation in replacement of ink cartridges according to a second exemplary embodiment of this disclosure is described with reference to FIG. 11.

Figure 12A:
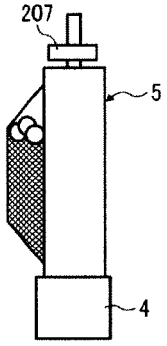
FIG. 12A is a side view of the head tank in a state in which bubbles are included in the head tank.
Figure 12B:
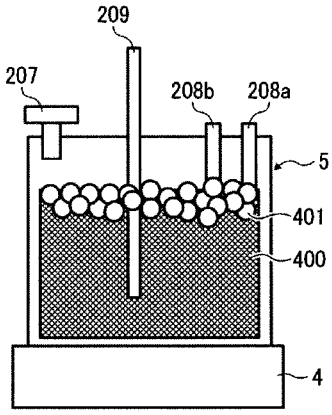
FIG. 12B is a front view of the head tank in the state illustrated in FIG. 12A.

In this exemplary embodiment, when the image forming apparatus is left unused for a long time, at S203 the controller 500 determines that, as illustrated in FIGS. 12A and 12B, the head tank 5 includes bubbles (air is mixed with ink in the head tank 5). Then, the controller 500 performs control steps of S204 to S208 similar to the above-described control steps of S104 to S108 in FIG. 8 performed when, in the first exemplary embodiment, the electrode pins 208*a* and 208*b* of the head tank 5 do not detect the head tank 5 before ink feeding. By contrast, when the image forming apparatus is not left unused for a long time, at S203 the controller 500 determines that the head tank 5 does not include bubbles (air is not mixed with ink in the head tank 5). Then, the controller 500 performs control steps of S209 to S213 in FIG. 11 similar to the above-described control process of S109 to S113 in FIG. 8 performed when, in the first exemplary embodiment, the electrode pins 208*a* and 208*b* of the head tank 5 detect the head tank 5 before ink feeding.

For example, by using a real time clock (RTC) that runs even while the image forming apparatus is stopped, the controller 500 may measure an elapsed time after the apparatus stops. Based on whether or not the elapsed time is a threshold time or more, the controller 500 can determine whether or not the image forming apparatus is left unused for a long time.

Figure 13:
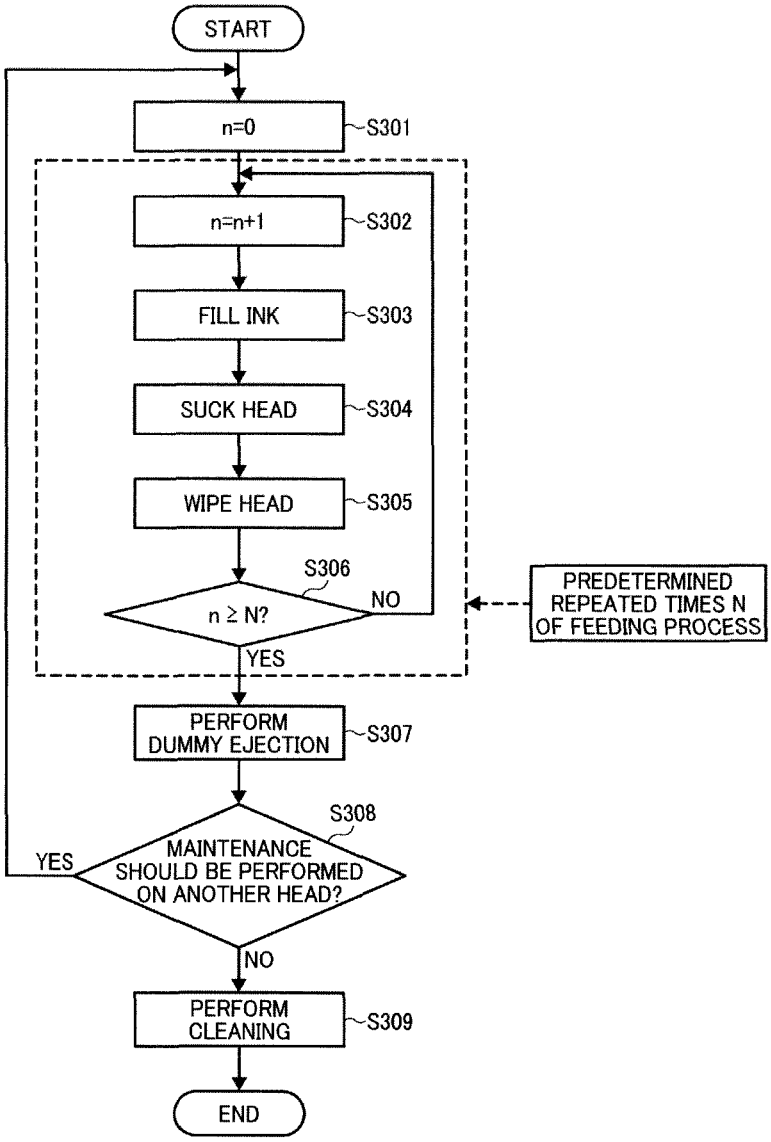
FIG. 13 is a flowchart of a control process of liquid feed maintenance.

Next, a control process of liquid feed maintenance is described with reference to FIG. 13.

In the above-described first and second exemplary embodiments, when the electrode pins 208*a* and 208*b* of the head tank 5 do not detect the ink level or the controller 500 determine that the head tank 5 includes bubbles, the air release unit 207 is opened and ink is fed in reverse from the head tank 5 to the ink cartridge 10. Then, the ink cartridge 10 is replaced and liquid feed maintenance is performed.

In other words, after a counter n to count a number of times of liquid feeding is reset at S301, at S302 the counter n is incremented. At S303, ink filling is performed, and at S304 a recording head 4 is sucked. At S305, the recording head 4 is wiped. At S306, the controller 500 determines whether or not a count value of the counter n is a predetermined repeated times N or greater.

When the count value of the counter n is the predetermined repeated times N or greater (YES at S306), at S307 the recording head 4 performs dummy ejection. At S308, the controller 500 determines whether or not liquid feed maintenance should be performed on another recording head 4. When liquid feed maintenance should be performed on another recording head 4 (YES at S308), the process goes to S301 and the above-described steps of S302 to S306 are repeated on the another recording head 4. By contrast, when liquid feed maintenance need not be performed on another recording head 4 (NO at S308), at S309 cleaning is performed.

The number of times the liquid feeding process is performed and information on whether or not cleaning has been performed are stored on an internal recording memory.

When a cover of a cartridge holder portion to mount the ink cartridge 10 is opened, the ink cartridge 10 may be removed from the cartridge holder portion, which may generate bubbles in the supply passage. Therefore, when the cover of the cartridge holder portion is opened, the liquid feed maintenance is suspended. In addition, when the image forming apparatus is powered off, the liquid feed maintenance is suspended. Furthermore, when a cover of the replaceable waste liquid tank 100 is opened, the waste liquid tank 100 may be removed, which may cause ink leakage. Therefore, when the cover of the replaceable waste liquid tank 100 is opened, the liquid feed maintenance is suspended.

When the liquid feed maintenance is suspended in the above-described cases or other cases (e.g., errors of the apparatus), the image forming apparatus, after recovery, resumes the liquid feed maintenance based on a progress information stored on the internal recording memory. Such a configuration can prevent unnecessary ink consumption and increase in the maintenance time.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head to eject droplets of liquid;

a head tank to store the liquid to be supplied to the recording head;

a main tank to store the liquid to be supplied to the head tank;

a reversible liquid feed device disposed between the main tank and the head tank;

a controller to control the liquid feed device to feed the liquid from the main tank to the head tank and in reverse from the head tank to the main tank;

an air release unit disposed at the head tank to open an interior of the head tank to an atmosphere; and a liquid level detector to detect a liquid level of the liquid in the head tank, wherein, when the main tank is in an ink end state and in any of a case that the controller determines that in the head tank a remaining amount of liquid is large and an amount of air is small and a case that the controller determines that in the head tank the remaining amount of liquid is small and the amount of air is large, the controller causes the liquid feed device to feed a reverse feed amount of the liquid in reverse from the head tank to the main tank with the air release unit opened to release an interior of the head tank to the atmosphere, when air is unlikely to be mixed with the liquid in the head tank or the liquid is unlikely to be bubbled in the head tank before a new main tank is installed in replacement of the main tank, the controller causes the liquid feed device to feed the liquid from the main tank to the head tank with the air release unit opened after the new main tank is installed in replacement of the main tank; and when air is likely to be mixed with the liquid in the head tank or the liquid is likely to be bubbled in the head tank before the new main tank is installed in replacement of the main tank, the controller causes the liquid feed device to feed a predetermined amount of liquid equal to or greater than the reverse feed amount from the main tank to the head tank with the air release unit closed after the new main tank is installed in replacement of the main tank.

2. The image forming apparatus of claim 1, wherein, when the liquid level detector detects the liquid level, the controller determines that air is unlikely to be mixed with the liquid in the head tank, and when the liquid level detector does not detect the liquid level, the controller determines that air is likely to be mixed with the liquid in the head tank.

3. The image forming apparatus of claim 1, wherein, when a stop time of the image forming apparatus is a predetermined time or less, the controller determines that the liquid is unlikely to be bubbled in the head tank, and when the stop time of the image forming apparatus is greater than the predetermined time, the controller determines that the liquid is likely to be bubbled in the head tank.

* * * * *